US007778559B2

(12) United States Patent
Omelchenko

(10) Patent No.: US 7,778,559 B2
(45) Date of Patent: Aug. 17, 2010

(54) METHOD TO IMPROVE DATA COLLECTION ACCURACY BY IMPROVED WINDOWING IN A TONER DENSITY CONTROL SYSTEM

(75) Inventor: Mark A. Omelchenko, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 159 days.

(21) Appl. No.: 11/852,357

(22) Filed: Sep. 10, 2007

(65) Prior Publication Data

US 2009/0067859 A1 Mar. 12, 2009

(51) Int. Cl.
*G03G 15/00* (2006.01)

(52) U.S. Cl. ..... 399/49

(58) Field of Classification Search ..... 399/49; 347/19; 358/406, 504
See application file for complete search history.

(56) References Cited

U.S. PATENT DOCUMENTS 6,044,234 A 3/2000 Yoshizawa
6,684,035 B2 * 1/2004 Furno et al. ..... 399/49
7,221,882 B2 * 5/2007 Nakagawa ..... 399/49
2001/0046391 A1 * 11/2001 Koide ..... 399/51
2008/0193148 A1 * 8/2008 Bonino ..... 399/15

* cited by examiner

*Primary Examiner*—Sophia S Chen

(57) ABSTRACT

A method of compensating for mechanical and magnification errors affecting toner density control in an image forming device is described herein. The method includes directing light towards a toner test surface, sensing the resulting reflections, and buffering the density data corresponding to the sensed reflections during a predetermined test window. The method may compensate for mechanical and magnification errors associated with the toner test pattern by processing the buffered density data to adjust the location of the data collection windows corresponding to the toner test patterns. For example, the buffered density data may be processed to detect first and second boundary patterns disposed on the toner test surface within the test window, determine a time differential between the first and second boundary patterns, and adjust the location of the data collection windows based on the determined time differential and a nominal expected time differential.

19 Claims, 8 Drawing Sheets

METHOD TO IMPROVE DATA COLLECTION ACCURACY BY IMPROVED WINDOWING IN A TONER DENSITY CONTROL SYSTEM

BACKGROUND

The present application relates generally to image forming devices, and more particularly to toner density tests in image forming devices.

Image forming devices optically form a latent image on a photoconductive member, and develop the image by applying toner. The toner is then transferred—either directly or indirectly—to a media sheet where it is deposited and fixed, such as by thermal fusion. In particular, it is known to successively transfer developed color-plane images from one or more photoconductive members to an intermediate transfer member, and subsequently transfer the developed image to a media sheet for fixation thereon. Examples of an image forming device utilizing an intermediate transfer member are the Model C750 and C752 devices from Lexmark International, Inc. Alternatively, it is known to direct a single media sheet past one or more photoconductive members, each of which successively transfers a developed color-plane image directly to the media sheet. An example of a direct transfer device includes Model C534, also from Lexmark International, Inc.

A problem common to image forming devices, regardless of their configuration, is toner density control. Numerous methodologies are known in the art for measuring the density of toner disposed on an intermediate transfer member or media sheet. Many of these include the steps of transferring developed images comprising test patterns of various forms to a test surface and detecting the developed images on the surface, e.g., detecting the presence of toner on the surface. One way to detect the toner is with optical density sensors.

Optical density sensors are well known in the art. An optical density sensor measures the presence, and may determine an amount (e.g., in $gm/cm^2$), of toner on a surface. This measurement may be performed indirectly, such as by sensing the differing optical properties of the surface and of toner deposited on the surface. One way to sense these properties is to illuminate the surface with a light source and sensing and measuring the resulting reflections. The sensed light is translated to toner density data through calibration procedures, as well known in the art.

The sensor outputs a data stream proportional to the sensed light. When the data stream is the result of reflections by a periodic group of toner patterns, the data stream includes periodic areas of data corresponding to the reflections caused by the test patterns interspersed with periodic areas of data corresponding to reflections caused by the intermediate transfer member or media sheet. To process the data associated with the toner test patterns, data collection windows are aligned with the toner test pattern data, and a controller processes the data contained within the data collection windows. It will be appreciated that the accuracy of the resulting toner density measurements directly relates to how accurately the data collection windows align with the actual test pattern data. The alignment may be compromised by an offset error caused by various mechanical tolerances, such as vibrations, velocity errors, sensor location errors, etc. Further, the alignment may be compromised by magnification errors, such as printhead magnification errors, that cause irregular spacing in the test pattern data relative to the regularly spaced toner test patterns. The alignment may also be complicated by the size of the toner test patterns. For example, the current trend is to reduce the size of the toner test patterns to increase productivity and to reduce the calibration time of the image forming device. However, smaller toner test patterns amplify the effects of the mechanical and magnification errors, which may cause processing errors that produce inaccurate toner density measurements.

FIG. 1 shows one prior art solution, which is described in U.S. Pat. No. 6,044,234. The illustrated process involves computing an offset error between a centerline for a nominal expected correction test pattern and a centerline for the actual correction test pattern. The position of the data collection window for subsequent toner test patterns is adjusted based on the computed offset error. In so doing, the prior art solution may correct for mechanical errors, but does not address magnification errors.

SUMMARY

The present application relates to a method of compensating for mechanical and magnification errors affecting toner density control in an image forming device. In one embodiment, the method includes directing light towards a toner test surface and sensing the resulting reflections. In one embodiment, the toner test surface comprises an intermediate transfer member or media transport member. In another embodiment, the toner test surface comprises a media sheet. The method may further include buffering density data corresponding to the sensed reflections during a predetermined test window, where the test window spans one or more toner test patterns disposed on the toner test surface. In one embodiment, the method compensates for mechanical and magnification errors associated with the toner test pattern by processing the buffered density data to adjust the location of the data collection windows corresponding to the toner test patterns. Processing the buffered density data may comprise detecting first and second boundary patterns disposed on the toner test surface within the test window, determining a time differential between the first and second boundary patterns, and adjusting the location of the data collection windows based on the determined time differential and a nominal expected time differential. In one embodiment, processing the buffered density data may comprise estimating a center line location for a toner test pattern relative to one of the boundary patterns based on the determined time differential, a nominal expected time differential, and a nominal expected center line location for the toner test pattern, and adjusting the center line location of the corresponding data collection window based on the estimated center line location.

DETAILED DESCRIPTION

Embodiments of the present application process buffered toner density data provided by an optical density sensor to measure the density of toner on a toner test surface. In one embodiment, a time differential between first and second boundary toner patterns, such as respective header and footer patterns, is determined and used to correct position errors associated with the data collection windows relative to the toner test patterns. In this manner, processing the buffered data corrects for both mechanical and magnification errors, even when small toner test patterns are used.

Figure 1:
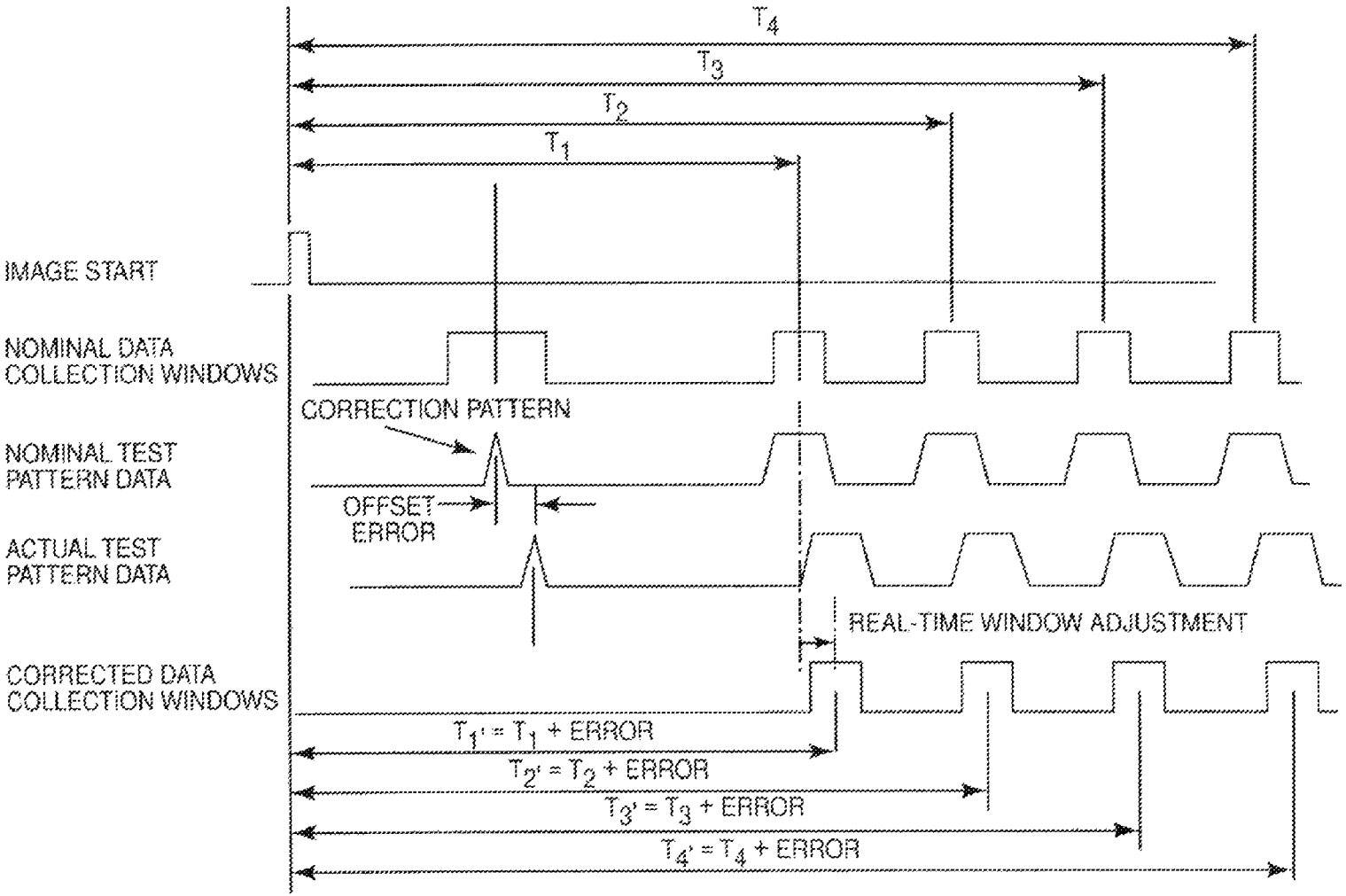
FIG. 1 (PRIOR ART)
FIG. 1 shows a signal diagram for one conventional toner density control system.
Figure 2:
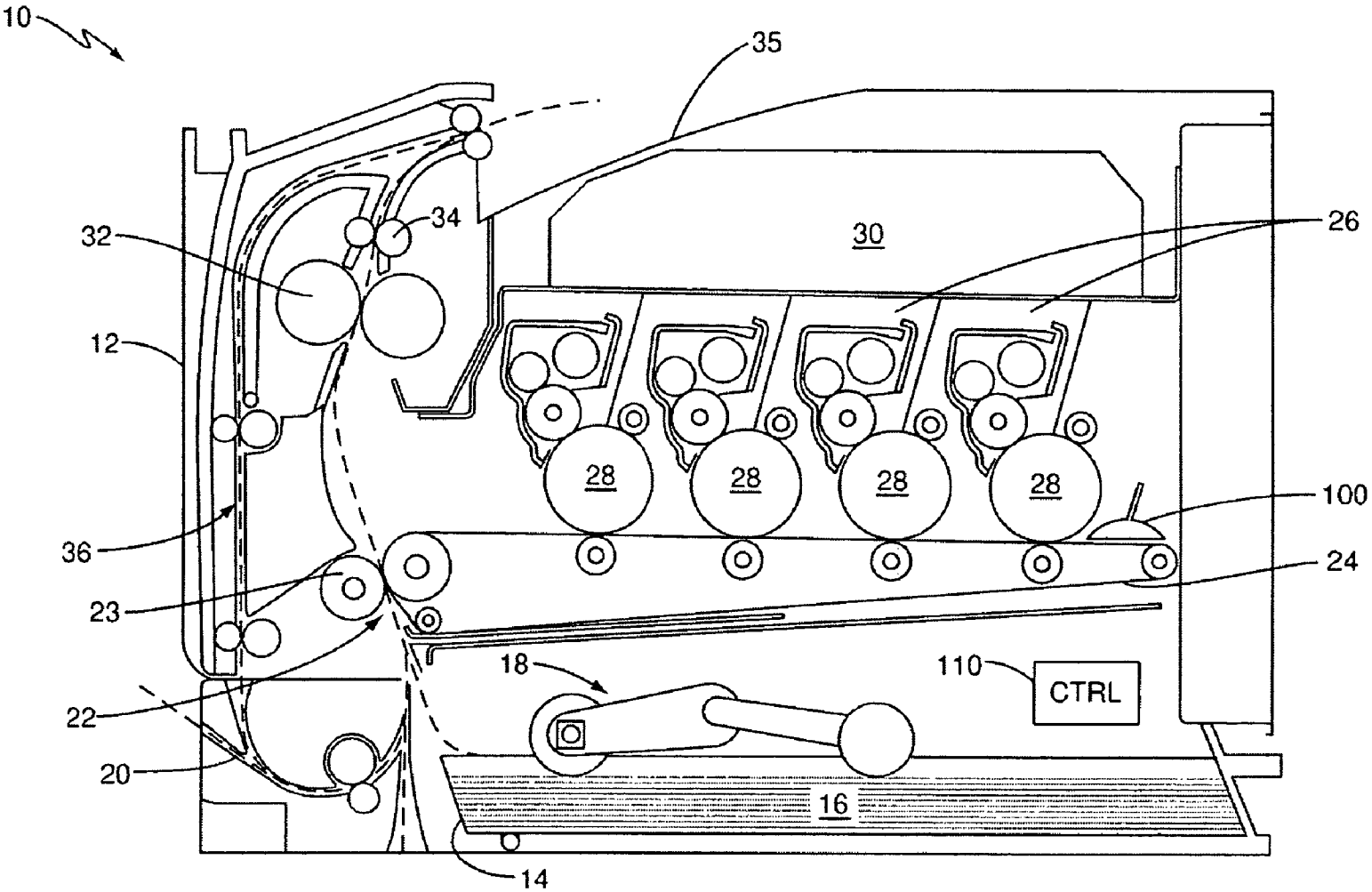
FIG. 2 shows a schematic diagram of a representative image forming device having an optical density sensor.

To facilitate the description of various embodiments, the following first provides a general description of one exemplary image forming device. It will be appreciated, however, that the various embodiments are not limited to the described or illustrated image forming device. FIG. 2 depicts a representative image forming device, indicated generally by the numeral 10. The image forming device 10 comprises a housing 12 and a media tray 14. The media tray 14 includes a main media sheet stack 16 with a sheet pick mechanism 18, and a multipurpose tray 20 for feeding envelopes, transparencies and the like. The media tray 14 is preferably removable for refilling, and located on a lower section of the device 10.

Within the housing 12, the image forming device 10 includes a transfer area 22 comprising a transfer nip formed by a transfer roller 23, an intermediate transfer member 24, one or more removable image forming units 26, a corresponding number of removable photoconductor units 28, an optical density sensor 100, an imaging device 30, a fuser 32, reversible exit rollers 34, and a duplex media sheet path 36, as well as various additional rollers, actuators, sensors, optics, and electronics (not shown) as are conventionally known in the image forming device arts, and which are not further explicated herein.

Each image forming unit 26 mates with a corresponding photoconductor unit 28 to form an imaging station, with the image forming unit 26 developing a latent image on the surface of a photoconductive member in the photoconductor unit 28 by supplying toner. Alternatively, the image forming and photoconductor units may be integrated into a single cartridge, as well known in the art. In a typical color printer, three or four colors of toner—cyan, yellow, magenta, and optionally black—are applied successively (and not necessarily in that order) to a print media sheet to create a color image. Correspondingly, FIG. 2 depicts four pairs of image forming units 26 and photoconductor units 28. At each photoconductor unit 28, a latent image is formed by the imaging device 30 and optically projected onto a photoconductive member. The latent image is developed by applying toner to the photoconductive member from the corresponding image forming unit 26. The intermediate transfer member 24 receives the toner images from each of the photoconductive members 28 and moves the images to the transfer area 22 where the toner images are transferred to the media sheet. In one embodiment, the toner images from each of the photoconductive members 28 are placed onto the intermediate transfer member 24 in an overlapping arrangement. In one embodiment, a multi-color toner image is formed during a single pass of the intermediate transfer member 24. By way of example as viewed in FIG. 2, the yellow toner is placed first on the intermediate transfer member 24, followed by cyan, magenta, and black.

The operation of the image forming device 10 is conventionally known. Upon command from control electronics 110, a single media sheet is "picked," or selected, from either the primary media stack 16 or the multipurpose tray 20. Alternatively, a media sheet may travel through the duplex path 36 for a two-sided print operation. Regardless of its source, the media sheet is presented at the transfer area 22, which aligns the media sheet and precisely times the transfer of the toner from the intermediate transfer member 24 to the media sheet at the transfer area 22. The toner is thermally fused to the media sheet by the fuser 32, and the sheet then passes through reversible exit rollers 34, to land in the output stack 35 formed on the exterior of the image forming device body 12. Alternatively, the exit rollers 34 may reverse motion after the trailing edge of the media sheet has passed the entrance to the duplex path 36, directing the media sheet through the duplex path 36 for the printing of another image on the back side thereof.

To facilitate toner density control operations, the image-forming apparatus 10 includes one or more optical density sensors 100 disposed proximate a toner test surface downstream of the image formation stations. For the image forming device 10 shown in FIG. 2, the toner test surface may comprise the intermediate transfer member 24. Optical density sensor 100 in conjunction with controller 110 is operative to detect and measure the density of toner deposited on the intermediate transfer member 24. A plurality of optical density sensors 100 may be employed, such as for example, two sensors 100 aligned along the scan direction (e.g., perpendicular to the direction of media travel) to detect image skew. While the following describes the toner density control in terms of toner disposed on the intermediate transfer member 24, it will be appreciated that the optical density sensor 100 may be disposed proximate other toner test surfaces, as discussed further below.

Figure 3:
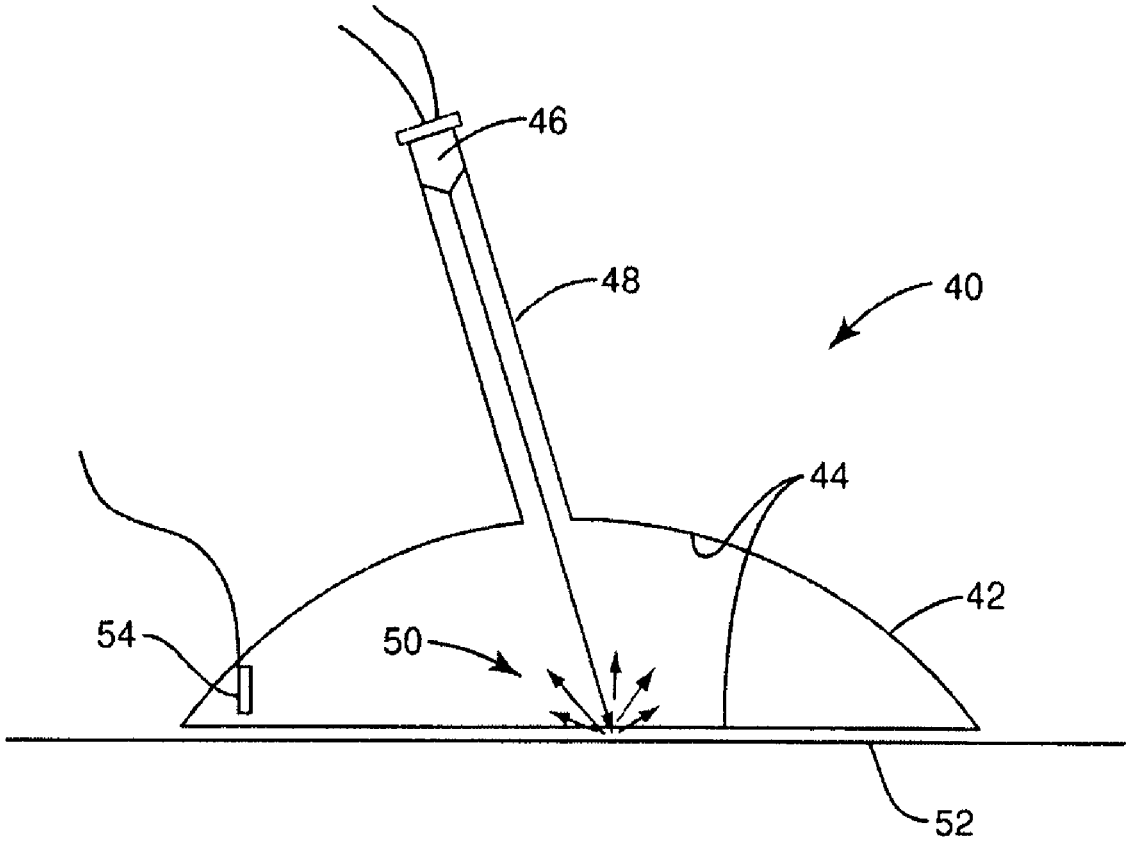
FIG. 3 (PRIOR ART)
FIG. 3 shows an exemplary optical density sensor.

One known form of optical density sensor is called an integrating cavity reflectometer (also known in the art as an integrating sphere reflectometer), a representative schematic diagram of which is depicted in FIG. 3, and indicated generally by the numeral 40. The reflectometer comprises an integrating cavity 42 having a diffuse, highly reflective interior surface 44. A light source, such as a light emitting diode (LED) 46 is disposed in a collimator 48, and emits collimated light through the cavity 42 and out a view port 50, onto the intermediate transfer member 24. The purpose of the collimator 48 is to form a non-divergent beam of light so that all of the light that comes into the cavity 42 from the source 46 will go out the view port 50. Any light from the source 46 that directly hits the interior surface 44 will corrupt the measurement. Light incident on the toner test surface 52 will be absorbed or reflected (and/or transmitted if the test surface 52 is transparent). If the cavity 42 is in contact with the toner test surface 52, or very close to it, the reflected light enters the cavity 42, where it is reflected by the interior surface 44 until it is absorbed or strikes an optical detector 54, such as a photodiode, disposed within the cavity 42. Light striking the optical detector 54 generates a voltage and/or current proportional to its intensity, which can be sensed and/or measured. The amount of light striking the optical detector 54 is proportional to the amount reflected from the target surface 52. It will be appreciated that while optical density sensor 100 may comprise the sensor 40 shown in FIG. 3, other types of sensors may also be used, e.g., those described in U.S. Pat. No. 7,122,800 entitled "Optical Density Sensor," which is incorporated herein by reference.

Figure 4:
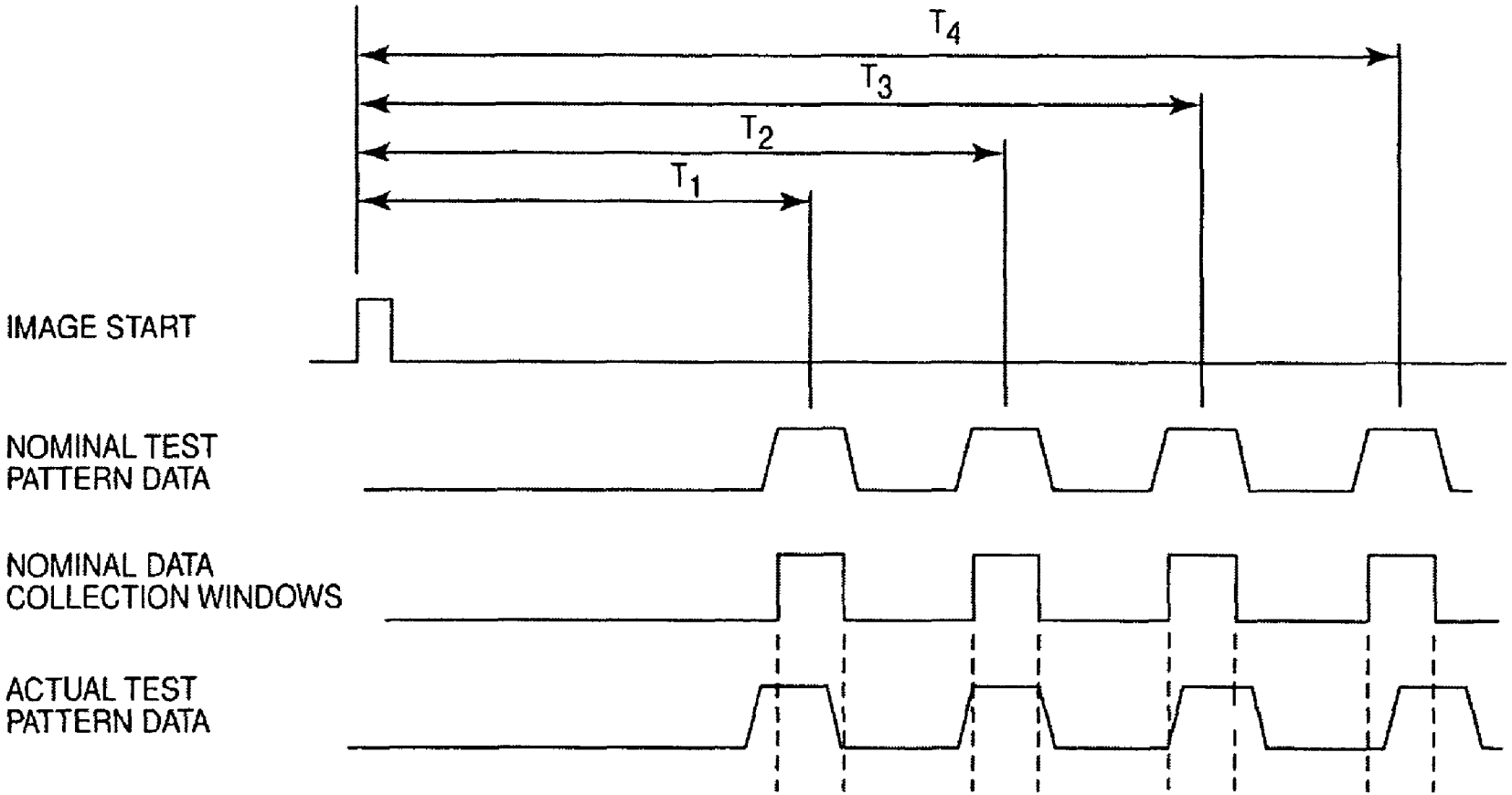
FIG. 4 shows a signal diagram for an expected and actual output of an optical density sensor.

FIG. 4 shows exemplary density data that may be provided by the optical density sensor 100 to controller 110 relative to nominal density data expected by the controller 110. As illustrated, the nominal test patterns and the nominal data collection windows align. However, the mechanical and magnification errors associated with the actual collected density data cause the nominal data collection windows to miss parts of the first, third, and fourth test pattern data. Further, it will be appreciated that as the size of the test patterns decreases, the problems caused by such mechanical and/or magnification errors will increase.

Figure 5:
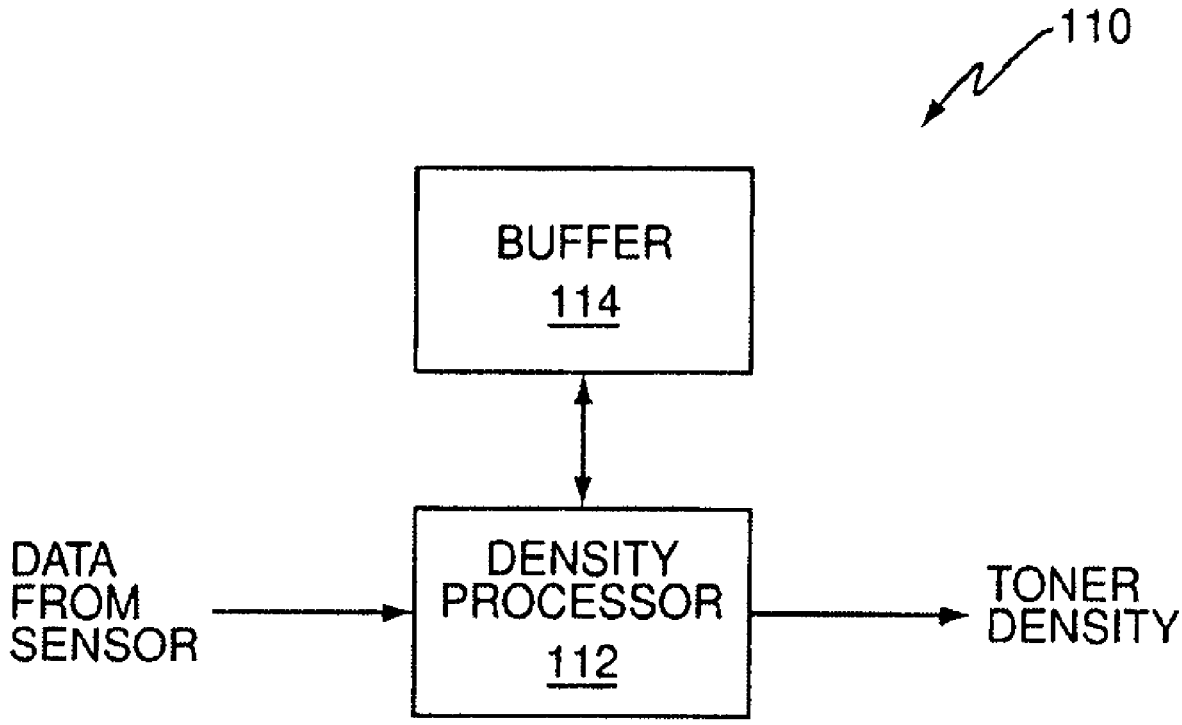
FIG. 5 shows a block diagram of a controller according to one exemplary embodiment.
Figure 6:
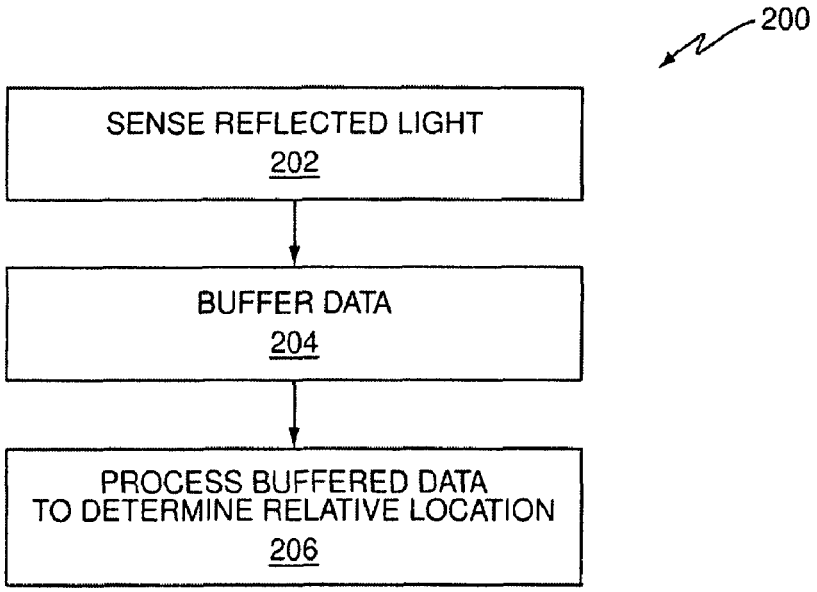
FIG. 6 shows a process diagram for compensating for position errors in one exemplary embodiment.

The present application buffers the toner density data collected by the optical density sensor 100 during a predetermined test window, and post-processes the buffered density data to compensate for the positional errors between the toner test patterns and the data collection windows. FIGS. 5 and 6 show a controller 110 and corresponding density measurement process 200, respectively, according to one exemplary embodiment. Controller 110 comprises a density processor 112 and a buffer 114. The optical density sensor 100 directs light to the intermediate transfer member 24, senses the resulting reflections, and outputs a data stream corresponding to the sensed reflections to the density processor 112 (block 202). The density processor 112 buffers the data over a predetermined test window in buffer 114 (block 204), and processes the buffered density data to adjust the position of the data collection windows relative to the actual toner test patterns (block 206), and processes the data in the data collection windows according to any known means.

Figure 7:
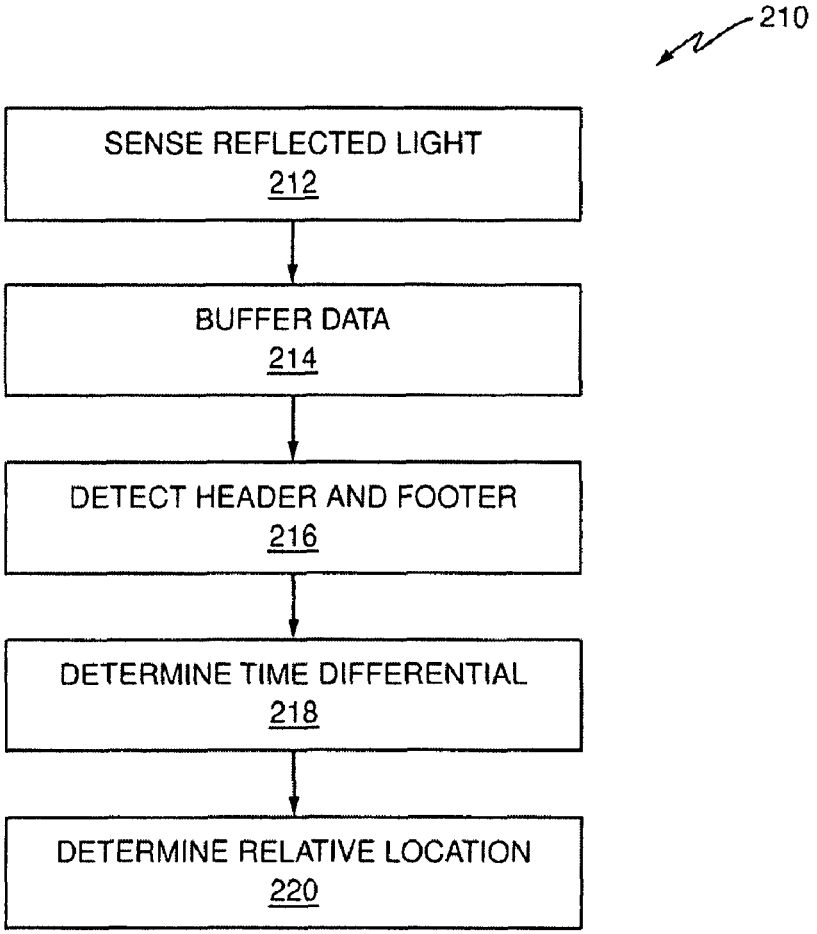
FIG. 7 shows a process diagram for compensating for position errors in one exemplary embodiment.

FIG. 7 shows another process 210 for compensating for toner test pattern position errors according to one exemplary embodiment that may be implemented by the controller 110. The optical density sensor 100 senses the reflections and provides the corresponding data stream to the density processor 112 (block 212). The density processor 112 buffers the data in buffer 114 over a predetermined test window (block 214). Subsequently, the density processor 112 detects a header pattern and a footer pattern in the buffered data (block 216), and determines a time differential between the detected header and footer patterns (block 218). Density processor 112 adjusts the position of the data collection windows relative to the header or footer pattern based on the relationship between the determined time differential and a nominal expected time differential (block 220). In one embodiment, the density processor 112 may first estimate a position of the center lines for the toner test patterns and adjust the position of the data collection windows based on the estimated center line positions.

Figure 8:
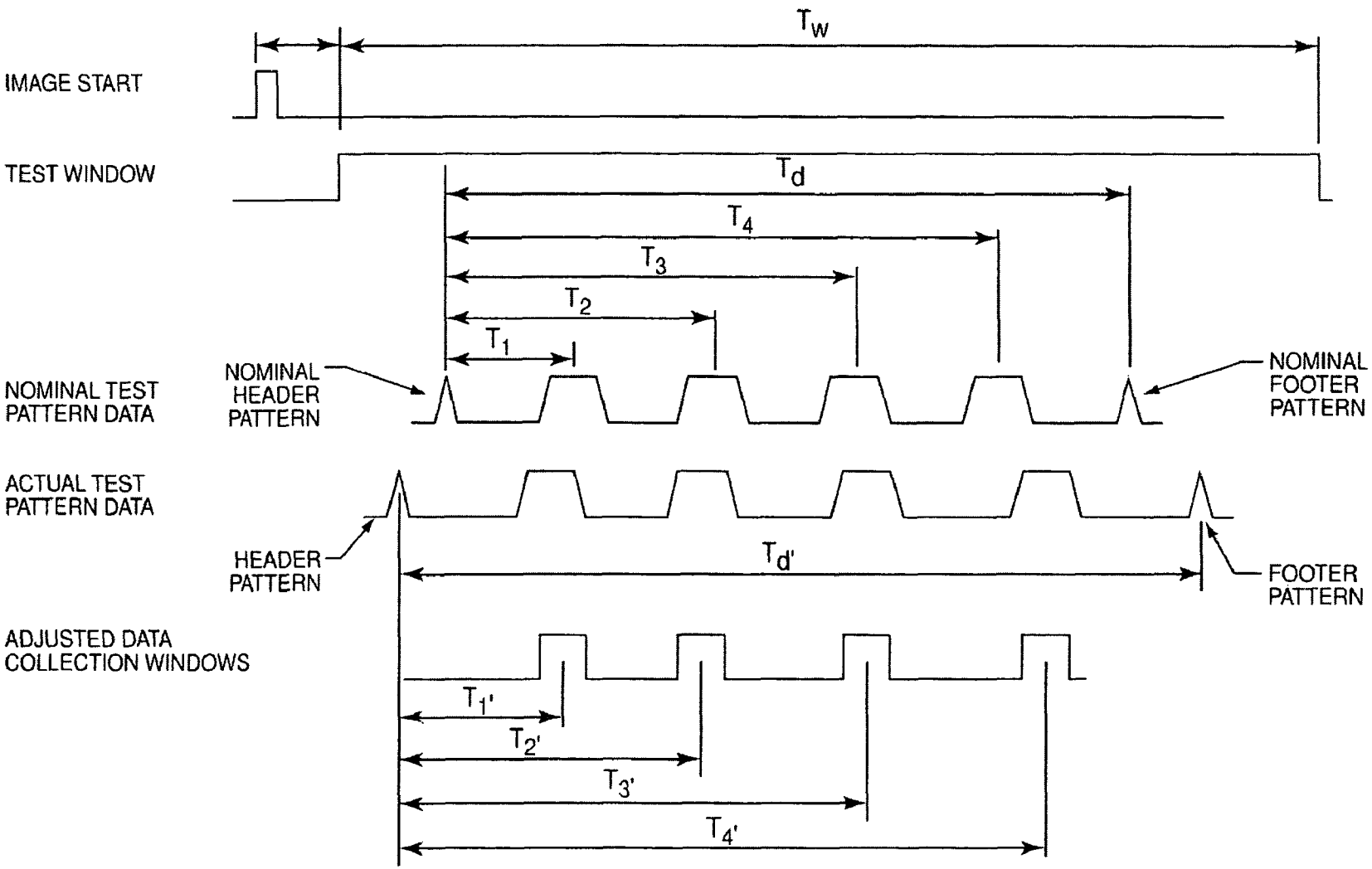
FIG. 8 shows a signal diagram for a toner density control system according to one exemplary embodiment.

FIG. 8 shows exemplary density data that may be provided by the optical density sensor 100 to controller 110 relative to nominal density data expected by the controller 110. In the illustrated example, data from the sensor 100 is collected and buffered by the controller 110 over a predetermined test window of length $T_w$. The buffered test data includes a header pattern and a footer pattern that bound four toner test patterns. The header and footer patterns represent boundary patterns that mark the respective beginning and end of the set of toner test patterns. The header and footer patterns may comprise any type of toner pattern detectable by the controller 110. To ensure that the header and footer patterns have sufficient toner to enable detection by the controller 110, even when one or more toner cartridges are in a toner-low or near-empty state, the header and footer patterns may be created using multiple colored halftones or dual colored solid areas. Further, to simplify processing associated with detecting the header and footer patterns, the header and footer patterns may be smaller than the collimated beam of light emitted by the optical density sensor 100. This causes the data corresponding to the header and footer patterns to have a distinctive peak, as shown in FIG. 8.

To correct for mechanical and magnification test pattern position errors relative to the data collection windows, the controller 110 first detects the header and footer patterns using any known means. For example, the controller 110 may use threshold detection to find a leading and trailing edge of each boundary pattern, and average the results to find the centroid. The controller 110 determines the actual time differential ($T_d'$) by detecting the actual header and footer patterns and measuring the corresponding time differential. The nominal expected time differential ($T_d$) between the nominal header pattern and nominal footer pattern, and the nominal expected times between the nominal header pattern and the center of each toner test pattern ($T_1$, $T_2$, $T_3$, $T_4$) are known to the controller 110. The controller 110 calculates the centerline location of the data collection windows relative to the header pattern ($T_1'$, $T_2'$, $T_3'$, $T_4'$) based on the calculated time differential ($T_d'$). It will be appreciated that the data collection window locations may alternatively be calculated relative to the footer pattern. Equation (1) shows one example of how the actual toner test pattern locations may be calculated.

$$T_1' = \frac{T_1 T_d'}{T_d} \qquad (1)$$

$$T_2' = \frac{T_2 T_d'}{T_d}$$

$$T_3' = \frac{T_3 T_d'}{T_d}$$

$$T_4' = \frac{T_4 T_d'}{T_d}$$

By adjusting the location of the data collection windows based on the nominal expected time differential relative to the actual time differential between the header and footer patterns, the above-described process compensates for both mechanical and magnification errors.

Although the above describes detecting and measuring the density of toner in one or more toner test patterns disposed on the intermediate transfer member 24, the optical density sensor 100 according to the present invention may be advantageously utilized to detect toner on any toner test surface. For example, in a direct transfer image forming device 10 shown in FIG. 9, the toner test surface may comprise a media sheet transport member 25 that transports a media sheet past the photoconductor units 28 to directly apply toner from the photoconductor units 28 to the media sheet. In this example, the toner test patterns may be disposed directly on the transport member 25. Alternatively, the toner test surface may comprise the media sheet, where the toner test patterns are disposed either directly (FIG. 9) or indirectly (FIG. 2) onto the media sheet. In this example, the optical density sensor 100 is disposed along the media path downstream from the imaging stations and/or transfer area to detect toner test patterns disposed on the media sheet.

Figure 9:
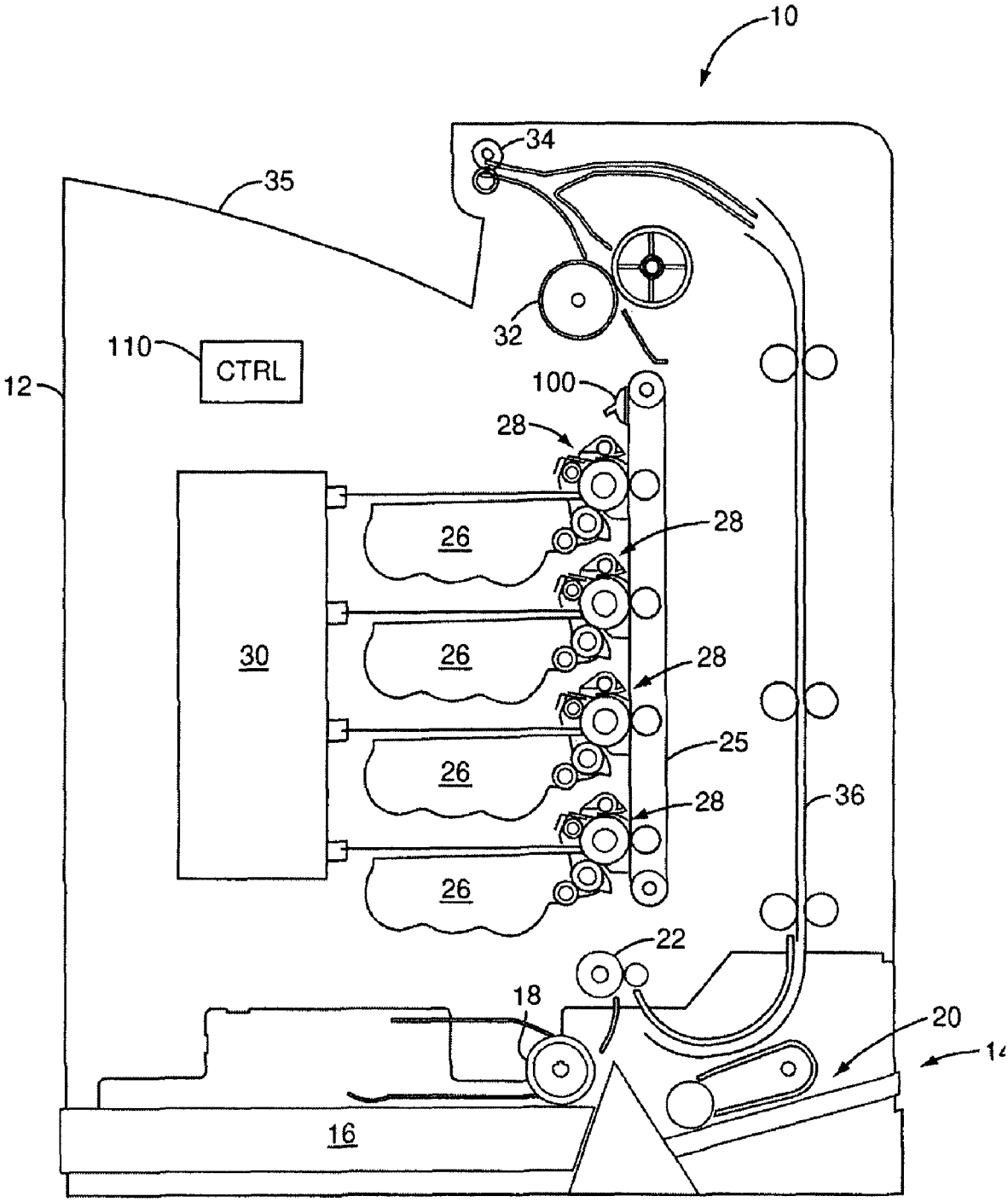
FIG. 9 shows a schematic diagram of a representative image forming device having an optical density sensor.

It will further be appreciated that the optical density sensor 100 may be advantageously located in other positions within the image forming device 10 than those shown in FIGS. 2 and 9. For example, where test operations are carried out on a transport member 25 or an intermediate transfer member 24, the sensor 100 may be located on the "back" side of the transport member 25 or intermediate transfer member 24, which may be advantageous in some embodiments, such as where the image forming stations leave little room on the "front" side of the transport member 25 or intermediate transfer member 24.

The present invention may be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method of compensating, for position errors affecting toner density control in an image forming device, the method comprising:

directing light towards a toner test surface and sensing resulting reflections;

buffering density data corresponding to the sensed reflections during a predetermined test window, said test window spanning one or more toner test patterns disposed on the toner test surface; and compensating for mechanical and magnification position errors associated with the toner test patterns by processing the buffered density data to adjust a location of one or more data collection windows corresponding to the one or more toner test patterns;

wherein the test window spans first and second boundary patterns that bound the one or more toner test patterns, and wherein compensating for toner test pattern position errors comprises:

determining a time differential between the first and second boundary patterns based on the buffered density data; and compensating for the toner test pattern position errors by adjusting a location of the data collection windows relative to the first boundary pattern based on the determined time differential and a nominal expected time differential.

2. The method of claim 1 wherein the first boundary pattern comprises a header pattern, and wherein the second boundary pattern comprises a footer pattern.

3. The method of claim 1 further comprising implementing toner density control based on the buffered density data in the adjusted data collection window.

4. The method of claim 3 wherein implementing toner density control comprises controlling a density of a first toner disposed on a media sheet based on the buffered density data in a corresponding first adjusted data collection window.

5. The method of claim 4 wherein controlling the density of the first toner comprises:

measuring a density of a first toner test pattern in the test window based on the buffered density data in the first adjusted data collection window; and controlling the density of the first toner disposed on the media sheet based on the measured density of the first toner test pattern.

6. The method of claim 4 wherein implementing toner density control further comprises controlling a density of a second toner disposed on the media sheet based on the buffered density data in a corresponding second adjusted data collection window.

7. The method of claim 1 wherein compensating for toner test pattern position errors comprises at least partially compensating for a mechanical error and a magnification error.

8. The method of claim 1 wherein sensing the resulting reflections comprises sensing light reflected by the toner test surface.

9. The method of claim 1 wherein sensing the resulting reflections comprises sensing light reflected by toner disposed on the toner test surface.

10. The method of claim 1 wherein the toner test surface comprises an intermediate transfer member or a media transport member.

11. The method of claim 1 wherein the toner test surface comprises a media sheet.

12. A method of compensating for position errors affecting toner density control in an image forming device, the method comprising:

buffering density data collected by a sensor proximate a toner test surface during a predetermined test window, said test window spanning first and second boundary patterns an a toner test pattern disposed on the toner test surface;

processing the buffered density data to detect the first boundary pattern and the second boundary pattern;

determining a time differential between the first and second boundary patterns; and compensating for the position errors by adjusting a location of a data collection window corresponding to the toner test pattern relative to the first boundary pattern based on the determined time differential and a nominal expected time differential.

13. The method of claim 12 wherein adjusting the location of the toner test pattern comprises further adjusting the location of the data collection window based on a nominal expected location of the toner test pattern.

14. The method of claim 12 wherein adjusting the location of data collection window comprises adjusting a location of a center line of the data collection window relative to the first boundary pattern based on the determined time differential, the nominal expected time differential, and a nominal expected location of a center line of the toner test pattern.

15. The method of claim 12 further comprising processing the buffered density data within the adjusted data collection window to implement toner density control.

16. The method of claim 15 wherein processing the buffered density data comprises:

measuring a density of the toner test pattern in the corresponding adjusted data collection window; and implementing the toner density control based on the measured density of the toner test pattern.

17. The method of claim 12 wherein at least one of the first and second boundary patterns comprises two or more toner colors, and wherein the toner test pattern comprises a single toner color.

18. A method of compensating for position errors affecting toner density control in an image forming device, the method comprising:

directing light towards a toner test surface and sensing resulting reflections, said sensed reflections representative of toner density data;

buffering the density data collected by the sensor during a predetermined test window, said test window spanning first and second boundary patterns and a toner test pattern;

determining a time differential between the first and second boundary patterns in the test window based on the buffered density data;

estimating a location of a center line of the toner test pattern relative to the first boundary pattern based on the determined time differential, a nominal expected time differential, and a nominal expected location of a center line of the toner test pattern; and compensating for the position errors by adjusting a location of a center line of a data collection window corresponding to the toner test pattern based on the estimated location of the toner test pattern center line.

19. The method of claim 18 further comprising processing the buffered density data within the adjusted data collection window to implement toner density control.

* * * * *